United States Patent [19]

Svaty

[11] Patent Number: 4,623,005

[45] Date of Patent: Nov. 18, 1986

[54] METHOD OF AND APPARATUS FOR CONTROLLING WEFT THREADS IN A SHUTTLELESS LOOM

[75] Inventor: Vladimir Svaty, Liberec, Czechoslovakia

[73] Assignee: Elitex Koncern Textilniho Strojirenstvi, Liberec, Czechoslovakia

[21] Appl. No.: 620,108

[22] Filed: Jun. 13, 1984

[30] Foreign Application Priority Data

Jun. 15, 1983 [CS] Czechoslovakia ..... 4323-83

[51] Int. Cl.[4] ..... D03D 47/36

[52] U.S. Cl. ..... 139/452

[58] Field of Search ..... 139/450, 452, 435

[56] References Cited

U.S. PATENT DOCUMENTS

| | | | |
|---|---|---|---|
| 3,411,547 | 11/1968 | Bucher | 139/452 |
| 3,938,561 | 2/1976 | Scheffel | 139/452 |
| 4,342,340 | 8/1982 | Key et al. | 139/452 |
| 4,403,634 | 9/1983 | Jankovsky et al. | 139/452 |

*Primary Examiner*—Henry S. Jaudon

[57] ABSTRACT

Method of and apparatus for controlling a weft thread in a shuttleless loom, particularly a shuttleless weft-change loom. The apparatus has a rotary measuring device provided with a winding arm. In accordance with the invention, the weft thread is variably braked between a measuring point and a weft thread supply. In the apparatus of the invention the winding arm is provided with an open thread guide, and adjacent the measuring drum there is provided at least a pair of controlled presenter levers, the presenter levers preceded by positively controlled thread brakes.

2 Claims, 3 Drawing Figures

METHOD OF AND APPARATUS FOR CONTROLLING WEFT THREADS IN A SHUTTLELESS LOOM

This application relates to the coassigned application of Svaty, Ser. No. 321,275, filed Nov. 13, 1981 now abandoned.

This invention relates to a method of and apparatus for controlling weft threads in a shuttleless weft-change loom, the weft being measured by a rotary measuring device having a winding arm rotating at a speed which is variable relative to a measuring drum.

Shuttleless looms, including both pneumatic and hydraulic jet looms, find an ever increasing use in the textile industry. The original narrow warp machines have been widened to a width of more than 300 cms, and the original plain machines have been supplemented with a dobby and a weft mixing apparatus.

However, the development of looms permitting the mixing of weft threads or pattern weaving has not yet been completed, even though a first solution of this method has already been known for a long time, and prototypes of such principle have also been tested much later. For example, according to Czechoslovak patent No. 83 889, weft threads are presented to a detent of a single rotary measuring device which engages the selected weft thread and measures it off, after which a corresponding weft inserting nozzle effects insertion of such measured weft into the shed of a loom.

The rotary measuring device according to the above mentioned Czechoslovak patent complied with all envisaged requirements in the loom, but it did not ensure an accurate measurement of weft threads, whereby a large amount of waste ensued. The cause of this resided in the fact that the measuring stem in used did not control the last phase of weft insertion and it was not possible to accurately to fix the moment at which the weft thread encircling the weft measuring drum will slip, and it was also not possible either to completely exclude a direct posterior withdrawal of the weft thread from its bobbin, due to the force of inertia upon said weft thread at the end of its insertion.

A further improvement in the control of a weft thread has been achieved by means of a rotary measuring apparatus having a winding arm rotating at a speed which is variable relative to a measuring drum with which the winding arm cooperates. During the measuring period, said arm rotates in the direction of rotation of the measuring drum. At the time of weft insertion, the winding flyer moves in a direction opposite to the direction of rotation of the measuring drum, whereby an accurate control of the course of both the winding and the unwinding of the weft thread is achieved, so that the speed of the unwinding of the weft threads stays fixed in each phase. However, a drawback of this known solution resides in that it does not permit changing of weft threads, and prerequisites for a proper operation of a color-changing superstructure are also not fulfilled.

The present invention has among its objects the elimination of the above shortcomings of the prior art by providing a simple method and apparatus which are applicable to existing rotary measuring devices having a winding arm rotating at a speed which is variable relative to the speed of rotation of the measuring drum with which it cooperates.

This object is achieved by the method of the invention, in which, at the time of measuring during the insertion proper, a weft thread is at first braked at a position intermediate a measuring point and a weft supply, in due proportion to the force by which the measured-off thread is propelled during insertion into the warp shed, whereafter, upon withdrawal of the last convolution from the measure-off length of the weft thread, the latter is fully braked to a stop intermediate the supply and the measuring point. As a result the thus inserted weft thread is stopped in a predetermined position at the moment of its withdrawal from the last convolution, whereby it is brought into its rest position in which it stays until it is caught next time, whereafter the intensity of its braking is again reduced.

The apparatus of the invention is particularly characterized in that the arm thereof is provided with an open hook-shaped weft thread guide, and that provided adjacent said measuring drum there is at least a pair of radially displaceable positively controlled presenter levers. The presenter levers are connected by a kinematic linkage to an upper shaft of the loom, said presenter levers being preceded by brakes which are positively controlled and coupled by a kinematic linkage to the main shaft of the loom.

An advantage of the method and apparatus of the invention resides particularly in that they can be applied to existing weft measuring devices having a winding arm rotating at a speed which is variable relative to the winding drum, without the necessity of carrying out constructional modifications of any great extent on the rotary measuring device.

Other advantages and features of the present invention will become apparent from a herein disclosed preferred embodiment thereof, described by way of example and shown in the appended drawings in which.

Figure 1:
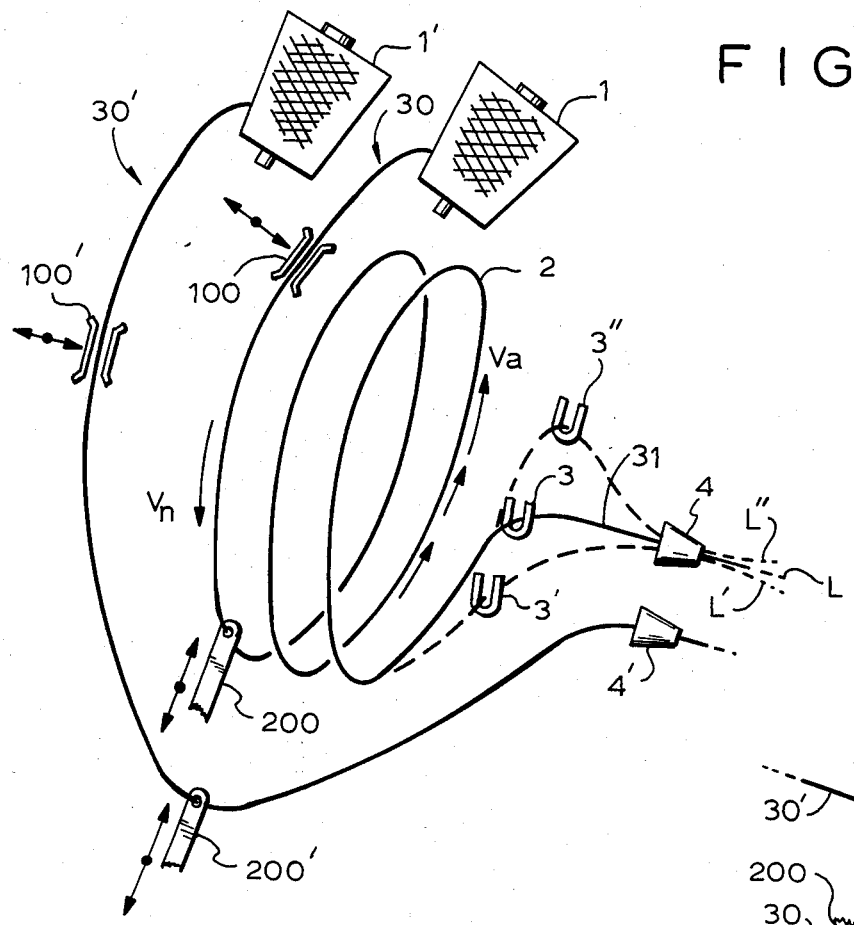
FIG. 1 is a diagram of the control of a weft thread during its being measured in a loom, such operation permitting weft mixing.

Turning first to FIG. 1, during the weft measuring operation a weft thread 30 is withdrawn, via a brake 100 and a presenter lever 200, from a supply wound on a bobbin 1 and is then continuously wound into a rotating helix 2. A leading end 31 of the weft thread 30 and helix 2 is guided towards inserting means constituted by a nozzle 4 of a jet loom in the present example. At the same time, rotary motion is imparted to the leading end 31 of the weft thread 30, for example by means of a thread guide 3 which rotates about the axis of the rotating weft helix 2. The speed at which the helix 2 rotates and, consequently, the winding speed also, are denoted by the character $V_n$, and they are constant. The speed $V_a$ at which both the thread guide 3 and the leading end 31 of the weft thread 30 are moved is variable, and can be higher or lower than the speed at which the helix 2 is rotated, or the thread guide 3 can also be rotated in a direction opposite from the direction of rotation of the helix 2. The relative speed and the direction of rotation of the thread guide 3 relative to the speed and direction of rotation of the helix 2 determine the length of the leading end 31 of the weft thread 30 upstream of the weft inserting nozzle 4 through which the weft guide extends. When the thread guide 3 is moved at a speed $V_a$ equal to that at which the helix 2 is rotated ($V_a = V_n$), the length L1 of the leading end 31 of the weft remains unchanged. This condition has been represented in FIG. 1 by a central position of the thread guide 3. When the speed $V_a$ of the thread guide 3 is lower than the speed $V_n$ at which the helix 2 is rotated, or when the thread guide 3 is moved in the opposite direction, the weft thread 30 is disengaged from the thread guide 3 and is displaced by the presenter lever 200 into its rest position, which is illustrated in FIG. 1 by position 200' of another weft thread 30' which is shown as having been withdrawn from a supply wound on another bobbin 1' and passed through another thread brake 100', presenter lever 200', and a stationary guide 25 to another weft inserting nozzle 4' of the loom.

Simultaneously with the displacement of the presenter lever 200 the other presenter lever 200 is also displaced, whereby the weft thread 30' is displaced from its rest position into its working position for measuring. However, when the thread guide 3 is moved at a speed $V_a$ higher than the speed $V_n$ of the rotating thread helix 2, then the length L of the leading end 31 becomes shorter under simultaneously winding into the rotating helix 2. Accordingly, three difference lengths (L, L', L'') of the weft thread 30 upstream of the nozzle 4 or 4' correspond to the three positions (3, 3', 3'') of the thread guide 3.

By controlling the two presenter levers 200, 200', thread brakes 100, 100', and the thread guide 3 and therewith the leading end 31 of the weft thread 30 or 30', respectively, so as to make the thread guide 3 change its speed and direction of rotation during each revolution of the main shaft of the loom and in dependence on the weaving process, fulfillment of a predominant majority of the above mentioned demands on weft measuring is ensured, as will become apparent in the description of a rotary weft metering apparatus for the performance of the above described method upon mixing the weft threads 30, 30'.

Figure 2:
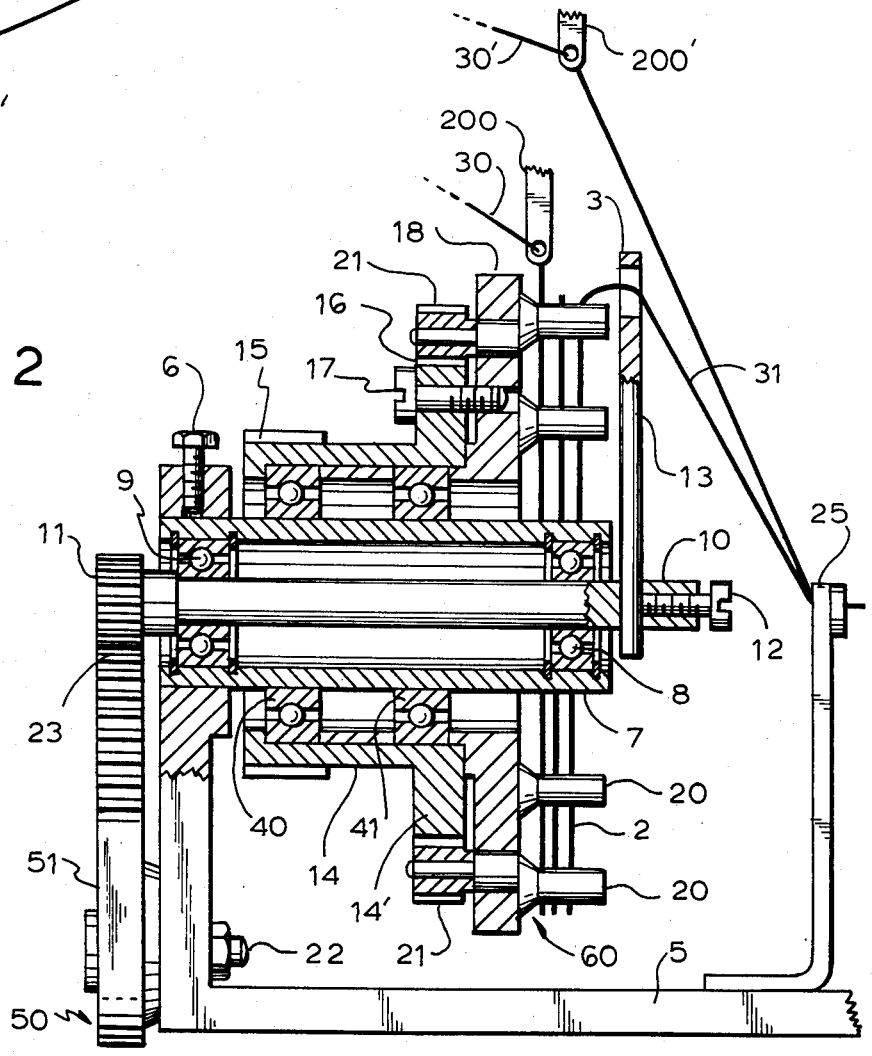
FIG. 2 is a view partially in side elevation and partially in vertical axially section through a rotary weft measuring device in accordance with the invention.
Figure 3:
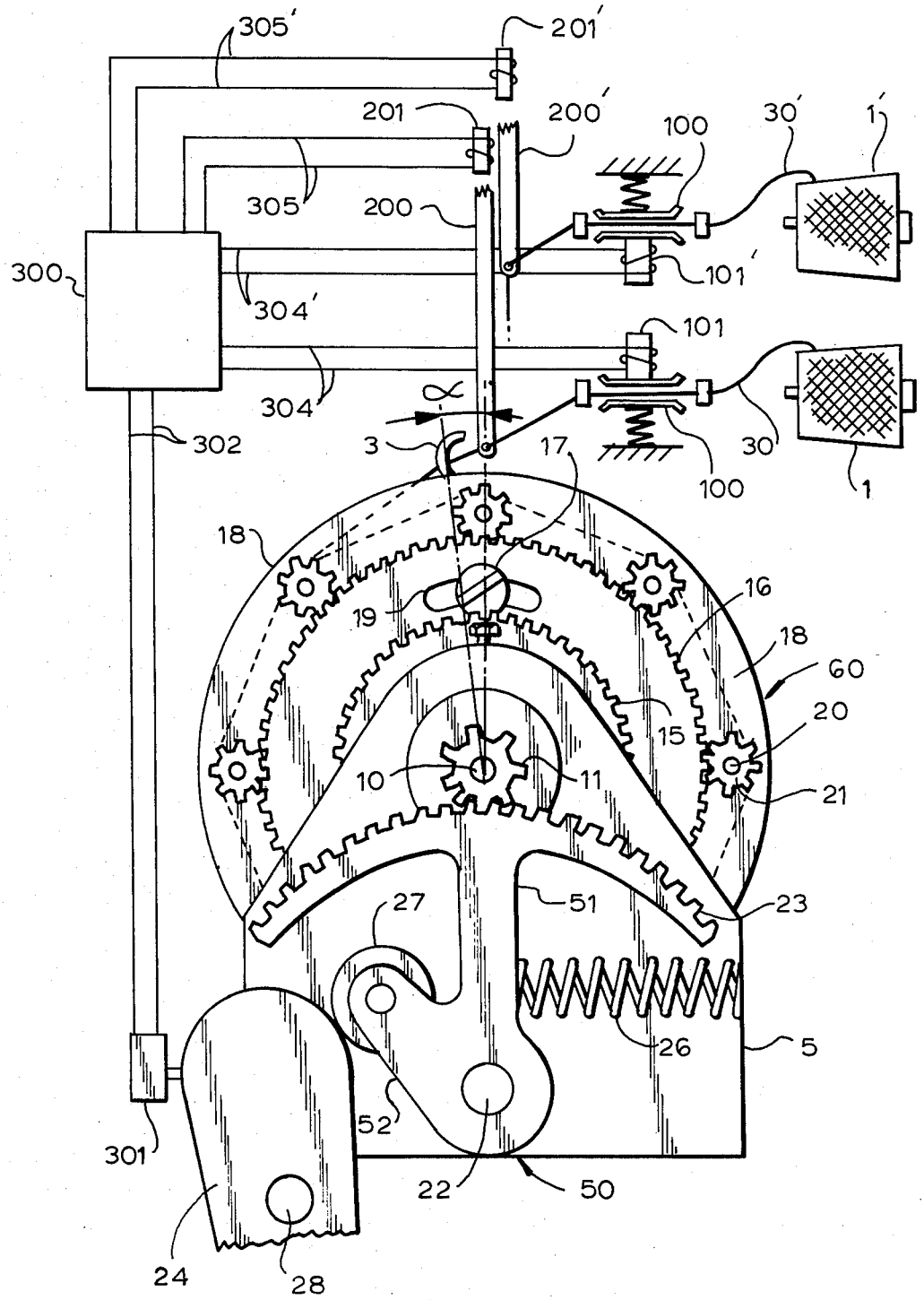
FIG. 3 is a fragmentary view mainly in end elevation, the view being taken in the direction from right to left in FIG. 2.

The rotary measuring apparatus shown in FIGS. 2 and 3 comprises a tube 7 fixedly mounted by means of a set screw 6 on a frame 5. Mounted in the tube 7 at the ends thereof are bearings 8 and 9 serving to support a shaft 10 disposed coaxially of the tube 7, shaft 10 and the left-hand end thereof (FIG. 2) having a pinion 11 affixed thereto and at the other end being provided with a diametrically oriented hole in which a radially arm 13 is mounted and held by means of a screw 12. Arm 13 carries at its outer-end a hook-shaped outlet thread guide 3.

Due to this manner of mounting of the arm 13 on the shaft 10, the arm 13 and the outlet guide 3 thereon are adjustable radially of the shaft 10.

Supported on the tube 7, by bearings 40, 41, there is a member having a tubular part 14 disposed coaxial of the tube 7 and the shaft 10, having a circumferentially extending tranverse flange 14' integrally mounted upon its right-hand end. The left-hand end of part 14 is provided with a ring gear 15, and the periphery of part 14' is provided with a ring gear 16. Attached to the member 14', which is in the form of a disk, by means of a screw 17 there is another disk 18 positioned to the right (FIG. 2) of part 14'. In order to permit a relative angular rotation of the parts 14, 14' on the one hand and 18 on the other, the screw 17 passes through a slot 19 provided in the member 14'. The disk 18 supports a radially adjustable measuring drum 60 for receiving weft threads 30 or 30' thereon. Drum 60 is constituted by rotatably mounted eccentric crank 20 which are solidly connected to respective pinions 21 meshing with the ring gear 16 on the member 14'. The drive of the measuring drum 60 is obtained via the ring gear 15 by a gear transmission (not shown) from a main shaft 28 of the loom.

Fixed to the frame 5 there is stub shaft 22, which pivotally mounts two-armed lever 50, on one arm 51 of which there is secured a toothed segment 23 meshing with the pinion 11 on the shaft 10. The other arm 52 of the two-armed lever 50 supports a rotatably mounted cam falling roll 27. The lever 51, 52, is constantly urged in a counter-clockwise direction (FIG. 3) by a coil compression spring 26, whereby the roller 27 constantly engages a perpiheral surface of the cam 24 fixedly mounted upon the main shaft 28 of the loom. The shape of the control cam 24 is chosen in dependence on the course of one cycle of the weaving process, i.e. in dependence on the angular position of the main shaft 28 of the loom. A kinematic linkage (only partially shown) including the control cam 24 is provided between the main shaft of the weaving machine, the presenter levers 200, 200', and the thread brakes 100, 100'. Said presenter levers 200, 200' disposed adjacent the measuring drum 60, are displaceable radially thereof either mechanically or by means of electromagnets 201, 201' the latter being positively controlled in dependence on the angular displacement of the control cam 24. In a similar way, the thread brakes 100, 100', disposed intermediate the presenter levers 200, 200' and the bobbins 1, 1' supporting the supplies of the weft threads 30, 30', are also positively controlled, preferably by electromagnets 101, 101', as shown. In the case of an embodiment intended for mixing of weft threads 30, 30', control by conductors 305, 305', respectively, of the electromagnets 101, 101' of the thread brakes 100, 100', as well as control of the electromagnets 201, 201' of the presenter levers 200, 200', respectively, is most simply effected by means of a stepping relay 300 connected by conductors 302 to a switch 300 provided adjacent to the control cam 24, and operated thereby. For fancy weaving, it is necessary to control the electromagnets 101, 101', 201, 201' in dependence on the angular displacement of the main shaft in accordance with a chosen program and, therefore, for example a numerical control must then be used instead of the stepping relay 300. For guiding the weft thread 30, 30' to the inserting means, i.e. the nozzles 4, 4', the stationary thread guide 25 is disposed within the rotation axis of the drum 60 of the rotary measuring device.

The above described apparatus operates as follows:

The measuring drum 60, driven via the ring gear 15, is rotated four times as fast as the main shaft 28 of the loom and, consequently, performs four revolutions for each cycle of the loom. Three of the four revolutions of the measuring drum 60 and at least a part of the fourth revolution are used for winding of the weft thread 30 or 30' thereupon, and during the fourth revolution of the measuring drum 60 the arm 13 is rotated three revolutions backwards, thus releasing the length of the weft thread 30 or 30' from drum 60. The backward movement of the arm 13 extends at an angle $\alpha$ (FIG. 3) beyond the connecting line between the presenter lever 200 or 200' and the thread guide 25. As a result, the weft thread 30 or 30' is unthreaded from the thread guide 3 at a fixed time, so that a change of the presenter levers 200, 200', becomes possible by means of electromagnets 201, 201'; respectively, after the switch 301 has been closed by the control cam 24. As shown, brakes 100, 100' are controlled, respectively, by the relay 300 through the conductors 304 and 304', respectively.

Due to unthreading of the weft thread 30, 30' and due to slow stopping of the arm 13 an increase in tension of the weft threads 30, 30' is prevented. The thread brakes and the arm 13 are positively controlled in dependence on the angular position of the loom main shaft 28. They are controlled by the electromagnet 101, 101' from the stepping relay 300 after the switch 301 has been closed by the control cam 24.

In a pneumatic loom equipped with the weft inserting and changing system according to the invention, its weft insertion starts at 90°, i.e. a quarter of a revolution after beat-up. During weft insertion, the pneumatic nozzle 4 or 4' propels the weft thread 30 or 30' by a force of approximately 0.04 N (Newton) through the warp shed. The weft thread 30 or 30' is looped three times around the rotary drum 60, and when the thread brakes 100, 100' are also adjusted to apply a force of 0.04 N, to the respective weft thread, then there is no danger of slippage of the weft threads 30 or 30' on the drum. After further rotation of the arm 13 through 45°, it is rotated one and one-half revolution in a direction opposite to that of the measuring drum 60, so that the windings of the weft thread 30 or 30' are reduced by one-half.

As the backward rotation of the arm 13 is continued, the force exerted upon the weft thread by the nozzle 4 or 4', and the force exerted thereon by the thread brake 100 or 100', respectively, are in equilibrium. In order to have the position of the weft thread 30 or 30' always exactly fixed, the intensity of braking as exerted on the weft thread 30 or 30' by the corresponding thread brake 100 or 100' controlled by the electromagnet 101 or 101', is abruptly and heavily increased at the moment when there is a last securing convolution of the weft thread on the measuring drum 60, after the switch 301 has been closed by the control cam 24. Thereby an immediate slippage of the weft thread 30 or 30' takes place on the measuring drum 60. Since the moment of braking the weft thread 30 or 30' to a stop always corresponds to the same position of the control cam 24 and, consequently, of the arm 13, an absolutely accurate measuring of a length of the weft thread 30 or 30' is achieved, as well as disengagement of the weft thread from the thread guide 3 on the arm 13 upon the simultaneous stoppage thereof.

When mixing the weft threads 30, 30' simultaneously with the electromagnets 101 or 101' of the thread brakes 100 or 100' respectively, the electromagnet 201 or 201' of the presenter lever 200 or 200', respectively is actuated, after the switch 301 of the stepping relay 300 has been closed. This causes the withdrawal of the corresponding lever 200 or 200' away from the measuring drum 60, whereas the other of the presenter levers 200' or 200 is advanced towards the measuring drum 60. Thereby, the one of weft threads 30 and 30' that has just been measured is brought into its rest position; in FIG. 2 it is the weft thread 30', which has been brought into its rest position, whereas weft thread 30 is brought into its measuring position, as shown in FIG. 2. In such measuring positioning the intensity of breaking of the weft thread is simultaneously reduced.

For fancy weaving, changing of weft threads is carried out according to a pattern, so that, for example, the weft thread 30 after having been measured and brought into its rest position, is again displaced by the presenter lever 200 into its working position, even several times in succession, before a change of the weft threads 30, 30' takes place.

According to the invention, an accurate measuring of weft threads is ensured by a relatively simple and accessible method permitting the withdrawal of the weft threads 30, 30' either from the bobbins 1, 1' respectively, or from currently produced feeders which warrant a continuous withdrawal.

It is to be understood that the above described apparatus is only one of a number of possible embodiments in accordance with the present invention which utilize a catch-hook and a slowed down motion thereof at the end of weft insertion, and which ensure the movements thereof to be carried out in exact synchronism with the control of the thread breaks.

Although the invention is described and illustrated with reference to a single of embodiment thereof, it is to be expressly understood that it is in no way limited to the disclosure of such preferred embodiment but is capable of numerous modifications within the scope of the appended claims.

We claim:

1. Method of controlling a weft thread in a shuttleless weft-change loom, said weft thread being measured by a rotary measuring apparatus having a winding arm rotating at a speed which is variable relative to a measuring drum cooperating therewith, comprising the following steps: at the time of measuring of the weft thread and during its insertion proper, the weft thread is at first braked at a position intermediate a measuring point and a weft thread supply, the braking of the weft thread being in due proportion to the force by which the measured-off thread is propelled during its insertion into the warp shed, after which, upon withdrawal of the last convolution of the measured-off length of the weft thread from the measuring drum, the weft thread is fully braked to a stop intermediate said supply and said measuring point, whereby the weft is stopped in a predetermined position at the moment of withdrawal of the said last convolution thereof, and subsequently it is brought into its rest position by the winding arm, after which the winding arm is then disengaged from the weft, the weft staying in its rest position until it is next caught by the winding arm, the intensity of braking of the weft being again reduced after the weft has been again caught by the winding arm.

2. Apparatus for controlling a weft thread in a shuttleless weft-change loom, comprising a rotary weft measuring device having a rotating measuring drum, adjacent to which there is provided a rotary arm cooperating therewith, said rotary arm having an open hook-shaped weft thread guide thereon, and a positively controlled thread brake disposed intermediate a bobbin supporting the weft thread supply and the rotary measuring device, and adjacent to the measuring drum there is at least one radially displaceable positively controlled presenter lever, kinematic linkage means operatively connecting the presenter lever to the main shaft of the loom, said thread brake being positively controlled and kinematically coupled to the main shaft of the loom.

* * * * *